United States Patent [19]

Simonson

[11] 4,062,769

[45] Dec. 13, 1977

[54] ELASTOMER SCREEN UNITS FOR SHAKER-SCREEN BODIES

[75] Inventor: Gordon Leon Simonson, Frederic, Wis.

[73] Assignee: Durex Products, Inc., Luck, Wis.

[21] Appl. No.: 633,947

[22] Filed: Nov. 20, 1975

Related U.S. Application Data

[63] Continuation-in-part of Ser. No. 534,585, Dec. 19, 1974, Pat. No. 3,943,054.

[51] Int. Cl.[2] ..... B07B 1/46

[52] U.S. Cl. ..... 209/399

[58] Field of Search ..... 209/392–399, 209/83, 307, 308; 210/498; 52/673; 29/163.5 R, 163.5 CW, 163.5 F, 160; 403/364, 161; 24/33 P, 33 R, 33 B, 33 C, 33 K, 33 M, 207; 74/231 J

[56] References Cited

U.S. PATENT DOCUMENTS

| | | | |
|---|---|---|---|
| 2,706,048 | 4/1955 | Riedel | 209/395 |
| 3,483,976 | 12/1969 | Williams | 209/399 X |
| 3,833,120 | 9/1974 | Ogata | 209/399 |

FOREIGN PATENT DOCUMENTS

| | | | |
|---|---|---|---|
| 2,303,913 | 8/1973 | Germany | 209/399 |
| 1,251,635 | 10/1967 | Germany | 209/392 |
| 2,108,854 | 8/1972 | Germany | 209/397 |
| 36,302 | 10/1971 | Japan | 209/397 |
| 241,350 | 3/1969 | U.S.S.R. | 209/392 |
| 145,489 | 6/1962 | U.S.S.R. | 209/307 |

*Primary Examiner*—Tim R. Miles
*Assistant Examiner*—Ralph J. Hill
*Attorney, Agent, or Firm*—Williamson, Bains, Moore & Hansen

[57] ABSTRACT

Integrally formed, elastomer screen units having a multiplicity of sorting apertures therein are provided for longitudinal and transverse connection in multiples to form screen bodies for sizing and sifting fragmented, hard-stock materials, each unit comprising a generally rectangular, preferably integral construction having upper and lower surfaces and first and second edges. The shaping of the first edge is preferably complemental to the shaping of the second edge and the same complemental relationship is true of the left and right lateral side edges of the unit. The units connected together in multiple are supported and mounted for hinge action on rods or stiff wires which extend transversely of the direction of flow of material along the shaker box or screen body.

5 Claims, 10 Drawing Figures

ELASTOMER SCREEN UNITS FOR SHAKER-SCREEN BODIES

CROSS REFERENCE TO RELATED APPLICATION

This application is a continuation-in-part of Ser. No. 534,585 filed Dec. 19, 1974, now U.S. Pat. No. 3,943,054 issued Mar. 9, 1976.

BACKGROUND OF THE INVENTION

For many decades separation, classification, sifting and dewatering of fragmented stocks of hard material such as crushed rock, aggregate, coal, sand and the like have been accomplished by shaker screen boxes having screen bodies made up either of coarse-woven steel or other metal netting, or of relatively thin sheet metal material provided with sieve openings arranged in predetermined sequence or manner. The abrasion and wear from hard material striking the charging surfaces of such screens, as well as the impact, tumbling and flow of hard material on such surfaces, has caused rather rapid deterioration of the metal material. Further, corrosion and deformation of the material from impact has shortened the life of such screens. The din and noise from the charging of such screens and the bouncing and tumbling of hard material thereon have been a source of noise pollution. In the last fifteen years several efforts have been made to lengthen the life of such metal screens by applying coatings of somewhat flexible elastic or elastomer material and in several instances whole screen bodies or sections of screen bodies involving a multiplicity of sizing apertures have been employed. Some of these have been supported and reinforced by an underlying mesh of steel, wires or the equivalent. Complicated molding processes have been required for such prior art shaker screens and because the manufacturer is required to make and have available screens having mesh sizes, sometimes square, sometimes round, sometimes elongate, and in as many as a hundred sizes, the investment or original cost of such processing, and in many instances the mold has been extremely high and prohibitive. Some prior structures have employed laminations of plastic or elastic sheets vulcanized to metal sheets and some have employed two or more plies of elastomer sheets of large size, properly punched or apertured for the sizing required.

It is a main object of the instant invention to provide an inexpensive, highly efficient elastomer, sectional screen unit readily connectible with a multiplicity of such units in directions both longitudinally and transversely of the direction of flow of fragmented, hard-stock materials to constitute collectively a full shaker screen. The embodiments of this invention are particularly adapted for sizing, sifting and dewatering fragmented hard-stock materials of the smaller sizes and preferably each unit is constructed integrally to provide a substantial number of sizing apertures with a minimal requirement of intervening solid material. With the employment of my invention, substantial economy is achieved in the original installation, in the cost of machinery or apparatus for either molding or die-cutting of the novel sectional units, as contrasted with the production of any known prior art sectional units.

One form of this invention is disclosed and illustrated in my U.S. Pat. No. 3,943,054 issued Mar. 9, 1976. Additional embodiments of the invention are herein disclosed and illustrated which provide for more efficient and simple interconnection of a multiplicity of the screen units and minimize mounting and support of the units while still affording independent hinge action of the screen units when interconnected with other units of the complete shaker screen.

SUMMARY OF THE INVENTION

As previously stated, the sectional screen units of this invention connected in multiplicity are particularly adapted for sizing and sifting fragmented, hard-stock materials of the smaller sizes. The body of each unit is preferably integrally formed from suitable elastomer material, molded, die-cut or otherwise formed in a generally rectangular shaped body having a multiplicity of sorting apertures. First and second edges of the unit, extend transversely to the direction of flow of material to be screened, and are complemental in shape to facilitate interconnections with other units of the sorting screen. Thus, for example, either of the described transvesely extending edges may be defined by rather closely spaced T-head formation elements while the remaining transverse edge is defined by substantially straight-spaced stem portions for closely fitting between the ends of the T-head elements of an adjacent connected unit. Also, the lateral or right- and left-hand edges of each unit are preferably formed of complemental shape so that when joined together transversely of the direction of flow of material over the multi-sectional screen, units may be supported upon a minimal number of rods or supporting wires and will at their junctures form sorting apertures with the requirement of minimal material to define such apertures.

The apertured, screen unit utilizes transverse integral elastomer bar segments extending transversely to the direction of material flow and longitudinal extending bar segments which taper in cross section from the upper or charging surface of the unit to the underside thereof and are perpendicular to the transverse bar segments. Certain series of the longitudinally extending bar segments are transversely apertured in alignment to receive and embed transversely extending supporting and positioning rods or wires which of course are interconnected with and supported from the frame on which the overall shaker screen is mounted.

In the preferred forms of my invention the multiplicity of sectional screen units is not only supported but interconnected and secured in place to constitute a full shaker screen by the conventional transverse supporting rods or wires. No vulcanizing between units, clips or other connection means, is necessary.

Great economy in the original installation costs of the machinery or molds for producing screen bodies is achieved with the use of my invention, since only one comparatively small set of molds or dies is required for one sectional unit. This is of great importance to a manufacturer when so many different dimensional meshes of screen are required for commercial sale.

The screen units, if impaired or unduly worn, are quickly replaceable as described hereafter in the specification, without removal of other units from the supporting wires or rods.

BRIEF DESCRIPTION OF THE DRAWINGS

The following description made in connection with the accompanying drawings will more clearly disclose details, construction, operations and new results obtained from my invention. In said drawings:

FIG. 5 is a plan view showing a plurality of said section units joined together and secured and supported upon a series of transversely anchored rods or stiff wires and illustrating how in multiple my units constitute a full body or screen bottom for use in shaker boxes and the like;

DESCRIPTION OF THE PREFERRED EMBODIMENTS

Referring now to the embodiment of the invention illustrated in FIGS. 1 to 5 inclusive, a sectional screen unit indicated as an entirety by the letter U is molded, die-cut or otherwise prepared in unitary form from a body of suitable elastomer material. Such exemplary plastic materials as styro-butadiene, carboxylated nitriles or polyurethane may be successfully employed. Rubber elastomers such as natural or synthetic rubber may also be successfully used for fulfilling the purposes and results of my invention.

Figure 1:
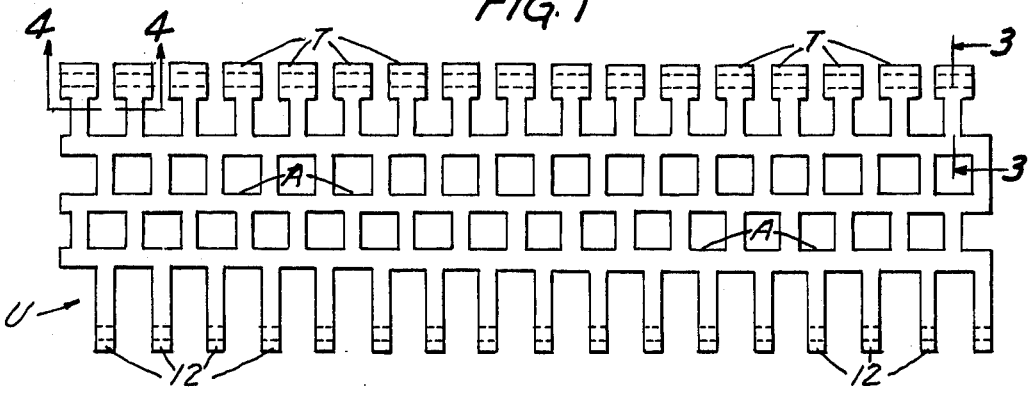
FIG. 1 is a top plan view of an integral, complete section or unit of a very satisfactory embodiment of my invention.
Figure 2:
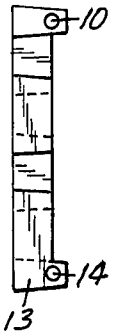
FIG. 2 is a right end elevation of the same.
Figure 5:
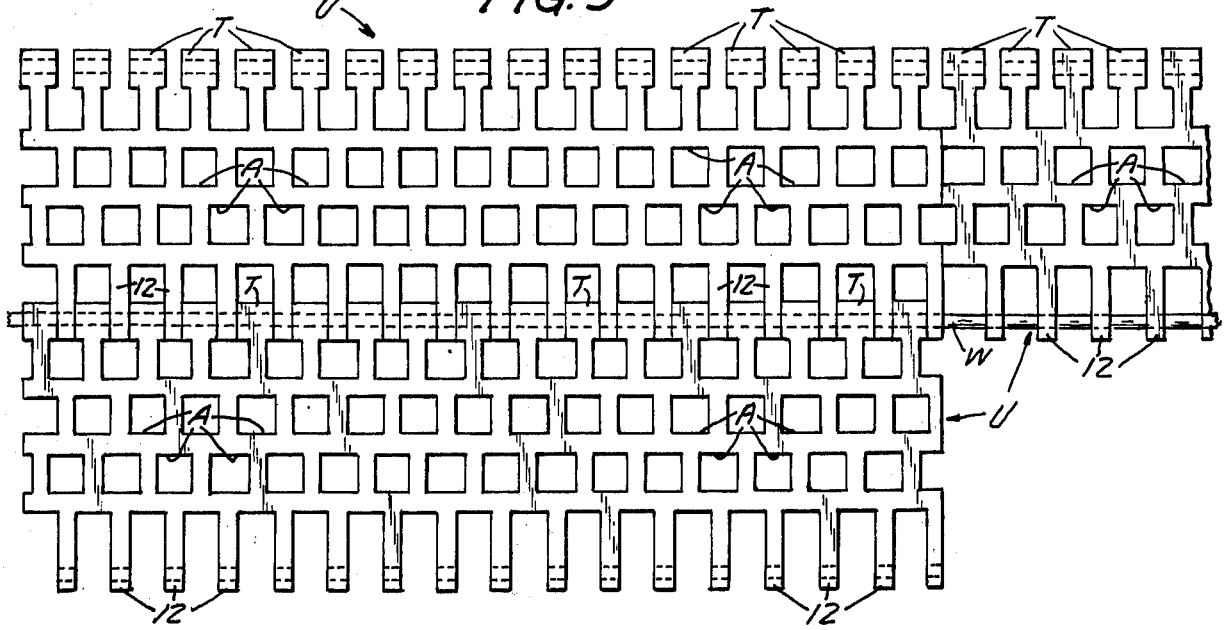

The central transverse rows and proportions of the unit U in FIG. 1 have rectangular sorting apertures A of rectangular shape, staggered as shown in FIGS. 1 and 2, although in other forms of the invention they may be placed in line with one another longitudinally parallel to the direction of the flow of the hard particulate material upon the screen. In the formation of these apertures, the material is molded or otherwise formed to taper downwardly from the upper surface of the unit, toward the lower surface, gradually increasing in cross-sectional area, thus facilitating penetration of particles which are of a size to go through the uppermost or charging surface of the unit. Such tapering is indicated partially in dotted lines in FIG. 2 and in full lines in FIGS. 3 and 4. The unit U is provided with first and second edges extending transversely to the direction of flow. The second edge of the sectional unit U is defined by outwardly projecting T-shaped connection elements T which have enlargements in the form of thickened T-heads apertured in alignment transversely of the entire unit by bores 10 to snugly receive positioning and support rods or heavy wires W as shown in FIG. 5. The opposite or first edge of the sectional unit U is defined by elongate, straight bars or projecting elements 12 which are sufficient in length to form sieving or sorting apertures of equal size to the apertures in the central rows identified as A, and to further extend outwardly to form side flattened connection portions 13 for interposition between the T-head portions T of the next successive unit to be joined in the direction of flow of the material to be sized or sifted. The outermost flattened ends 13 of said portions 12 for each unit are provided with transverse bores 14 which are in alignment transversely of the section and which are adapted to be aligned with the T-head portions T of the next successive unit joined as shown in FIG. 5 and interconnected by one of the positioning and supporting wires W which, of course, are employed in combinative operation with the units to constitute my invention. Each of the outwardly extending projecting elements along the first and second edges has a terminal end face extending between the upper and lower surfaces and confronting the adjacent units to which the projecting elements will be attached as described hereafter.

The left and right hand lateral edges of the sectional unit U extend generally parallel to the direction of flow and are complementary shaped so that a pair of the units may be joined transversely of the flow direction to continue the exact rectangular or other aperture shape of the units, and of course are joined together by the common rods or heavy wires W.

Preferably rods or stiff wires W extending transversely to the flow direction and supported from the sides of the shaker box are employed only in the transverse interconnection of the several units and thus provide for independent hinge action of the separate units. This is of substantial importance in providing yieldability on the original impact of the hard, particulate material upon the charging upper surface of the multi-sectional screen, and also mitigates and cushions tumbling action during the travel of the hard material downwardly in the flow over the screen. It will be understood that additional supporting and positioning wires may be employed through other suitable transversely aligned bores for screens for larger particles and for heavier fragments of crushed material.

When a multiplicity of said units are joined together as shown in FIG. 5, the sizing or sorting apertures are uniform throughout the entire screen body, and an important feature is that a very minimal amount of said material is employed to define the great multiplicity of sorting apertures.

From the foregoing description it will be seen that the entire shaker screen bodies or bottoms with a great variety of large dimensions may be made from my sectional unit structure supported and positioned simply upon transverse rods or wires common to the interconnected screen units. The sectional, apertured, unit enables capital costs for manufacture of a large variety of overall screen bodies of different size mesh to be very economically accomplished. Only one, relatively small and inexpensive mold or die for each mesh size is required with my improved construction.

A SECOND EMBODIMENT

Figure 6:
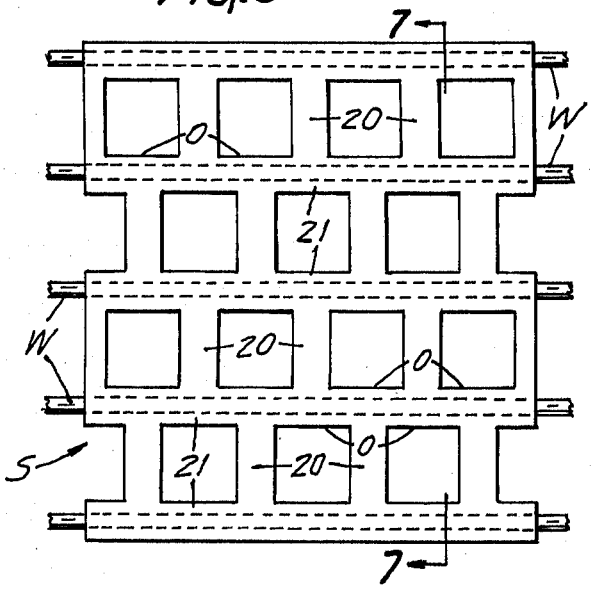
FIG. 6 is a plan view of another embodiment of the invention and is substantially identical to FIG. 6 in my U.S. Pat. No. 3,943,054.
Figure 7:
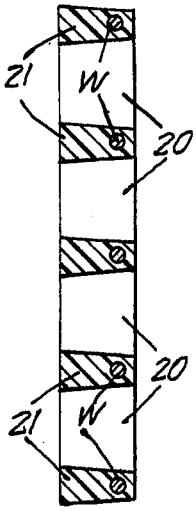
FIG. 7 is a cross section taken on the line 7—7 of FIG. 6.
Figure 3:
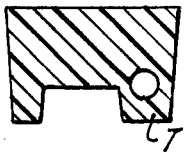
FIG. 3 is a cross section taken along the line 3—3 of FIG. 1.
Figure 4:
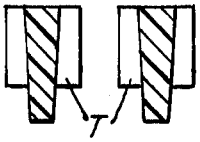
FIG. 4 is a cross section taken along the transverse section line 4—4 of FIG. 1 on a larger scale.

In FIGS. 6 and 7 of the drawings another embodiment of my invention is illustrated and as shown in the sizing apertures are of larger mesh than the form first described.

Here an apertured, screen unit S is produced, preferably by molding, having the staggered, rectangular longitudinal rows of sorting apertures O. The overall configuration is quite similar to the form first described and illustrated in FIGS. 1 to 5 inclusive.

Solid, narrow portions of the screen unit S comprise longitudinal bar segments 20 extending in the direction of flow of the material to be sized, together with transverse bar segments 21. Both bar segments are slightly tapered from their upper charging surface to their lower surface. This facilitates classifying of "through" size particles.

Unit S is preferably integrally molded or cast from a desirable elastomer material with the requisite number of transverse supporting wire-receiving bores cored or otherwise formed therein. Wires W may be embedded in the molds if two-part molds are used, and in such instance will have connection elements at their extremities for juncture with abutting screen units of similar structure. In fabricating a full screen body a multiplicity of the units S are vulcanized or otherwise secured and integrated along abutting edges.

In this form of the invention it will again be seen that flexibility and hinging of some of the elastomer material along the many wire reinforcing lines occurs during the charging, the vibration, and operation of this form of my invention.

A THIRD EMBODIMENT

Figure 10:
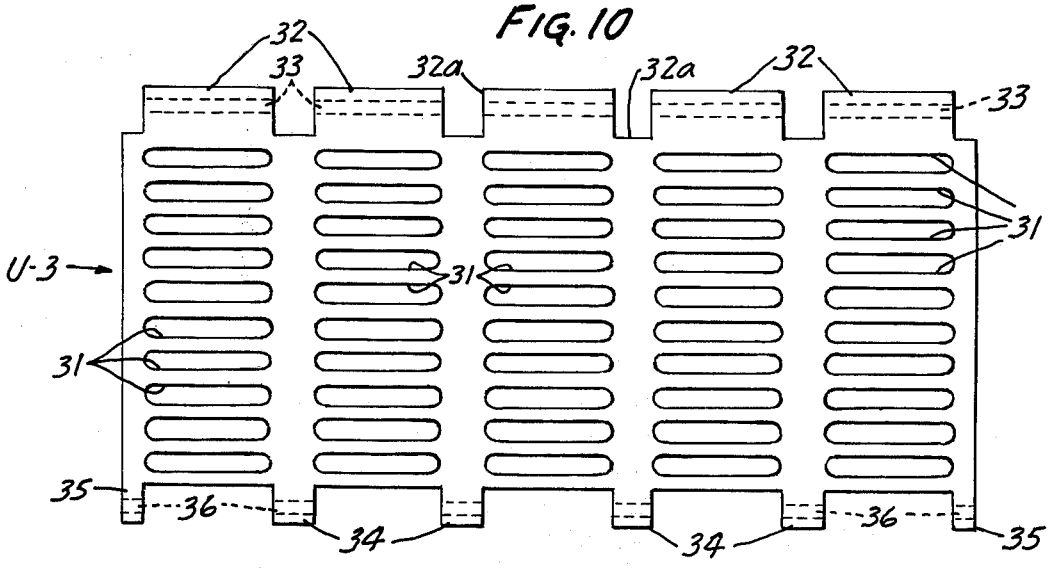
FIG. 10 is a top plan view of a slightly different form of the invention.

In FIG. 10, a top plan view, I illustrate a third embodiment of the invention, particularly adapted for classification or sifting of hard particle material which is slivery in nature. Again, an apertured, screen unit with a body constructed of suitable elastomer material is employed, indicated as an entirety by U-3. This body has a plurality of vertically aligned series of elongate, narrow sorting apertures 31. The apertures are defined by edges which taper, as disclosed in the previous forms of the invention.

A single mold or die of relatively small proportions may be utilized to form the unit which has first and second generally transverse edges as described hereinafter.

The transverse second edge of the unit is provided with relatively wide outwardly projecting elements or tongue portions 32 integrally formed with the body which along the general transverse second edge of the unit are spaced apart by rectangularly notched recesses **32*a*. These tongues have aligned bores 33 formed therein for receiving the rods or wiring for joining a multiplicity of the units and supporting the same in the proper operative position. The left hand and right hand ends of the series of tongues 32** are indented slightly inward from the lateral edges of the unit.

At the first edge of the unit, outwardly projecting elements or tongue members 34 are spaced apart in proper relation and dimensioned to be interposed in the joining of two units longitudinally of the flow direction in recesses **32*a* provided in the second edge of an adjacent to-be joined unit. These tongue members 34 are provided with aligned, transverse bores 36 for reception of the supporting wires or rods previously referred to. The end members abutting the lateral edges are of approximately half the width of the tongue member 34 and are identified as 35**. These narrower end tongue members interfit with the recesses formed at the extreme side portions of the second edge of the unit.

A FOURTH EMBODIMENT

Figure 8:
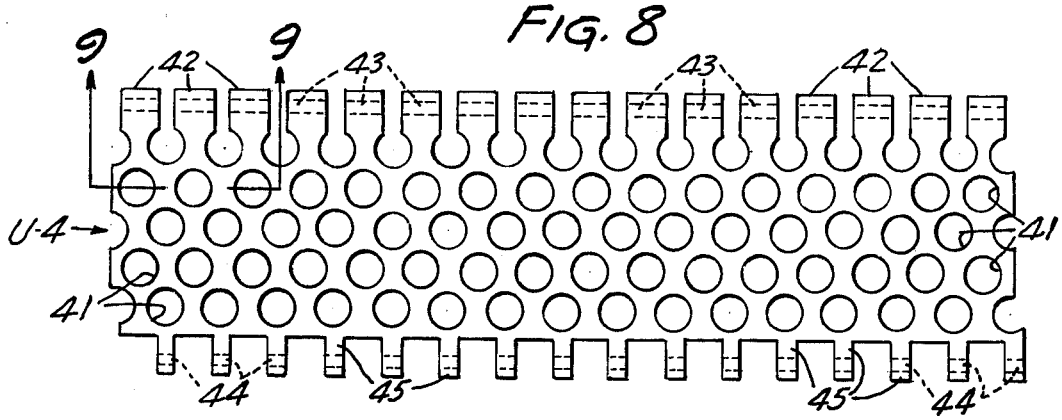
FIG. 8 is a plan view of another embodiment of the invention wherein the section is of a screen unit having differently shaped and somewhat differently cross sectionally formed sorting apertures.
Figure 9:
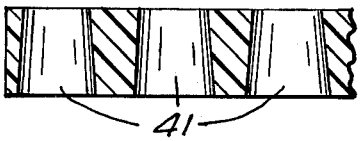
FIG. 9 is a cross section taken on the line 9—9 of FIG. 8.

FIG. 8 shows a plan view of a still further embodiment of the invention, having essentially all of the important characteristics and components of the form first described and illustrated in FIGS. 1 to 5 of the drawings. In this form the unit as an entirety is designated as U-4 and is provided with staggered rows of circular sizing or sorting apertures 41 which are tapered from the lower surface of the screen unit to the upper or charging surface, as is in common with the other forms of the invention. The section is formed of a body of elastomer material having first and second transverse edges. The second edge is defined by a plurality of outwardly projecting elements or tongue portions 42, all of equal size and shape, and having transverse aligned bores 43 formed therethrough to accommodate heavy wires or rods for the connection transversely of a plurality of the units and for support of the units in operative position.

The first edge of the unit U-4 is provided with a similar plurality of outwardly projecting elements or narrow tongue members 44 which are spaced apart and are adapted to be interposed between the tongue portions 42 of a second unit interconnected in logitudinal arrangement in line of the flow of material over the screen.

The side or lateral edges of the unit U-4 are similar in shape to cooperate in the joining of units transversely of the overall screen body formed to continue, without additional need for material, the staggered series of sizing apertures.

In all forms of my invention, any of the sectional units may be readily removed from the overall screen body and replaced without disconnecting the transverse interconnecting and supporting rods. To remove a unit the unit is transversely sliced directly over both supporting rods or wires. Any sharp cutting medium, such as a small rotary saw or a sharp knife, may be employed for such cutting. The unit is thereafter pushed downwardly into the bottom of the shaker box or trough and removed. The new replacement unit is transversely cut or sliced along appropriate transverse lines through its underside so that the slices or grooves formed intersect with the upper and lower transverse wire-receiving bores. Thereafter the new sliced unit may be forced downwardly upon the appropriate transverse rods and thus becomes interconnected with the other units and supported in the precise position of the worn or damaged unit replaced.

IMPORTANT ADVANTAGES AND NEW RESULTS OF INVENTION

From the foregoing description and the accompanying drawings, it should be apparent that the important advantages and new results achieved by my invention are essentially as follows:

1. Sectional elastomer units readily connectible in multiplicity for entire screen bodies may be very economically produced to provide entire screen bodies for shaker screens and the like, where the overall areas of the screens vary widely in dimensions and areas.

2. The sectional units with complemental first and second require for interconnection and support only a minimal number of transverse wires or rods secured conventionally to the sides of the shaker box or trough.

3. The individual units when damaged or worn may be readily removed and replaced without disconnecting the transverse support rods and without any dismantling of the overall screen body.

4. Screen bodies constructed from a multiplicity of my novel units will very substantially outwear and outlast any prior art sizing and sifting screens employing mainly metal nettings, apertured metal sheets or even plastic-coated metal apertured material.

5. My units will not corrode or rust in long continuous use and will not be damaged by acidic or alkaline chemicals which may be present in some of the hard particle materials serviced by the screen bodies.

6. The transversely joined units in operation will have hinge action on their respective supporting rods when heavy fragmented materials are discharged thereon and also during tumbling and shaker action of the material during flow of material over the screen.

7. Din and noise pollution during operation is very substantially reduced in comparison with most prior art apparatus.

8. Cost of manufacture and original installation costs of molds, dies or other machinery for production of screen bodies are very substantially reduced.

9. Juncture of a multiplicity of my novel units produces continuity of screen aperture pattern with minimal requirement of solid elastomer material intervening between the sizing apertures. It also provides for independent hinge action of the numerous units upon impact and tumbling of the hard material.

The term "rod-like members" as used in the claims is employed in its broad sense to include rods, wires and small diameter cables and the like.

What is claimed is:

1. In combination with a plurality of generally parallel rod-like supporting members spaced a predetermined distance apart, a multiplicity of individual screen units adapted to be interconnected to form a complete sorting screen with a flush sorting surface for sizing and sifting of hard fragmented material discharged thereon and flowed thereover in a predetermined flow direction:

each of said screen units comprising:

a generally rectangular body constructed of elastomer material, having first and second edges and upper and lower surfaces extending between said edges, and having a multiplicity of sorting apertures passing through said body from said upper surface to said lower surface;

each of said first and second edges being oriented transversely to said flow direction and each of said first and second edges including a plurality of transversely spaced apart elements projecting outwardly from said body and parallel to the flow direction with the transverse distance of separation between elements of said first edge being greater than between elements on said second edge, the arrangement of said elements at said second edge being complemental to that of said first edge, whereby in interconnection of two units along the flow direction the said projecting elements of a said first edge and a said second edge will be interposed in close side-by-side relation;

said plurality of projecting elements along said first and said second edges having transversely aligned bores therethrough for reception of one of said rod-like supporting members therethrough; and the distance between said bores of said first edge and said second edge of each unit being equal to the distance between two of said spaced apart rod-like supporting members and said bores being equally spaced from said upper surface, whereby a multiplicity of said units is interconnected and supported by said rod-like members to define said flush sorting surface.

2. The combination and structure set forth in claim 1 wherein said projecting elements at said first edge of each unit comprise spaced bars and said projecting elements at said second edge comprise complementally spaced bars with enlargements at the extremities thereof, said enlargements of a first unit being interposed between the spaced bars of a second unit when two units are interconnected in the direction of flow of the fragmented material.

3. The combination according to claim 1 wherein said spaced apart elements are swingably mounted on said rod-like members to permit said units to independently hinge about said rod-like members in response to impact and sorting of the fragmented material.

4. In combination with a plurality of rod-like supporting members spaced a predetermined distance apart; a multiplicity of individual screen units adapted to be interconnected to form a complete screen body for sizing and sifting of hard fragmented material discharged thereon and flowed thereover in a predetermined flow direction;

each of said screen units comprising:

a generally rectangular body constructed of elastomer material, having upper and lower surfaces and first and second edges, and having a multiplicity of sorting apertures passing through said body from said upper surface to said lower surface;

each of said first and second edges being defined by a plurality of spaced apart elements projecting transversely relative to said edges, the arrangement of said elements at said second edge being complemental to that of said first edge, whereby in interconnection of two units the said projecting elements of said units will be interposed in close side-by-side relation;

said projecting elements at said first edge of each unit comprising spaced bars and said projecting elements at said second edge comprising complementally spaced bars with enlargements at the extremities thereof, said enlargements of a first unit being interposed between the spaced bars of a second unit when two units are interconnected;

said plurality of projecting elements along said first and said second edges having aligned bores therein extending generally parallel to said first and second edges for reception of one of said rod-like supporting members therethrough;

the distance between said bores of said first edge and said second edge of each screen unit being equal to the distance between two of said spaced rod-like supporting members, whereby a multiplicity of said units is interconnected and supported by said rod-like members;

each said projecting element of said first and second edges including a terminal end face extending between said upper and lower surfaces, oriented transversely to said projecting element and located at an end of said projecting element;

said end faces located along said first edge being tapered toward said end faces located along said second edge from said upper surface to said lower surface so that the screen apertures defined by said end faces increase in cross sectional are from said upper surface to said lower surface; and said tapered terminal end faces swinging about said projecting elements as said units swing about said rod-like members to thereby cause the cross sectional area of screen apertures to vary as said units swing during screen vibration so as to encourage fragmented material in the screen apertures to be sifted through the screen body.

5. The combination of claim 4 wherein said bores through said projecting elements are positioned nearer to said lower surface than to said upper surface so as to increase the arc through which said terminal end faces of said projecting elements swing during vibrating movement of the screen body to thereby urge fragmented material in the screen apertures through the screen.

* * * * *

UNITED STATES PATENT AND TRADEMARK OFFICE

CERTIFICATE OF CORRECTION

PATENT NO. : 4,062,769

DATED : December 13, 1977

INVENTOR(S) : GORDON LEON SIMONSON

It is certified that error appears in the above-identified patent and that said Letters Patent are hereby corrected as shown below:

Column 1, line 61, Delete "comma".
Column 1, line 61, After "installation" insert --and--.
Column 4, line 42, Delete "said" and substitute --solid--.
Column 4, line 59, Delete "in".
Column 5, line 35, Delete "hereinafter" and substitute --hereafter--.
Column 6, line 57, After "second" insert --edges--.
Column 8, line 62, Delete "are" and substitute --area--.

Signed and Sealed this

*Fourth* Day of *July 1978*

[SEAL]

*Attest:*

RUTH C. MASON
*Attesting Officer*

DONALD W. BANNER
*Commissioner of Patents and Trademarks*